US006078149A

United States Patent [19]

Preis et al.

[11] Patent Number: 6,078,149

[45] Date of Patent: Jun. 20, 2000

[54] DEVICE FOR OPERATING A GAS DISCHARGE LAMP TO PRODUCE OUTPUT POTENTIALS HAVING DIFFERENT ABSOLUTE VALUES

[75] Inventors: Karl-Heinrich Preis; Robert Kern, both of Buehlertal, Germany

[73] Assignee: Robert Bosch GmbH

[21] Appl. No.: 09/101,596

[22] PCT Filed: Oct. 25, 1997

[86] PCT No.: PCT/DE97/02486

§ 371 Date: Nov. 17, 1998

§ 102(e) Date: Nov. 17, 1998

[87] PCT Pub. No.: WO98/21920

PCT Pub. Date: May 22, 1998

[30] Foreign Application Priority Data

Nov. 13, 1996 [DE] Germany ..... 196 46 861

[51] Int. Cl.[7] ..... H05B 37/02

[52] U.S. Cl. ..... 315/307; 315/82; 315/DIG. 7; 315/291

[58] Field of Search ..... 315/82, 77, 78, 315/307, 291, 209 R, 224, 308, DIG. 7, 247

[56] References Cited

U.S. PATENT DOCUMENTS

| | | | |
|---|---|---|---|
| 5,049,790 | 9/1991 | Herfurth et al. | 315/308 |
| 5,151,631 | 9/1992 | Oda et al. | 315/308 |
| 5,485,061 | 1/1996 | Ukita et al. | 315/307 |
| 5,514,935 | 5/1996 | Oda et al. | 315/82 |
| 5,565,743 | 10/1996 | Yamashita et al. | 315/82 |

FOREIGN PATENT DOCUMENTS

| | | |
|---|---|---|
| 41 41 804 | 2/1993 | Germany . |
| 42 18 647 | 8/1993 | Germany . |

*Primary Examiner*—Don Wong
*Assistant Examiner*—Wilson Lee
*Attorney, Agent, or Firm*—Kenyon & Kenyon

[57] ABSTRACT

A device for operating a gas discharge lamp has a d.c.-d.c. converter which converts an input voltage based on a reference potential into two output potentials different from the reference potential. The gas discharge lamp is brought by a drive circuit to these output potentials having different absolute values.

5 Claims, 1 Drawing Sheet

DEVICE FOR OPERATING A GAS DISCHARGE LAMP TO PRODUCE OUTPUT POTENTIALS HAVING DIFFERENT ABSOLUTE VALUES

FIELD OF THE INVENTION

The present invention concerns a device for operating a gas discharge lamp.

BACKGROUND INFORMATION

German Patent Application No. 42 18 647 describes a conventional high-voltage discharge lamp device in which the output voltage of the step-up d.c.-d.c. converter of the high-voltage discharge lamp is supplied with alternating polarities. Thus the voltage applied to the gas discharge lamp alternates in a square wave between positive and negative output voltage values of the d.c.-d.c. converter. At a constant polarity reversal frequency, the resulting average voltage applied to the gas discharge lamp thus corresponds to the reference potential. If the gas discharge lamp is accommodated in a housing which is also at this reference potential, there is no potential difference to suppress harmful migration of ions in the lamp.

To create a potential difference between the gas discharge lamp and the environment, German Patent No. 41 41 804 provides a part which is set to a positive potential in comparison with the gas discharge lamp. However, this arrangement involves an additional manufacturing expense.

SUMMARY OF THE INVENTION

The object of the present invention is to provide for a device for operating a gas discharge lamp to permit a long lifetime of the gas discharge lamp.

A d.c.-d.c. converter converts an input voltage based on a reference potential into two output potentials that are different from the reference potential and are characterized in that their absolute values are different. Such a bipolar d.c.-d.c. converter has some specific advantages, such as the fact that the requirements of the electronic components are lower due to more favorable voltage sharing. It is thus possible to use circuit-breakers or diodes of a lower electric strength. In addition, with the gas discharge lamp driven alternately with the two output potentials, an average potential different from the reference potential is established. The resulting potential difference has a positive effect on the lifetime of the gas discharge lamp inasmuch as it reduces interactions of the gas ions with the lamp body, and diffusion of ions into the lamp body can be reduced.

In an alternative exemplary embodiment according to the present invention, a first output voltage which bases the first output potential on the reference potential, has a different polarity from a second output voltage, which bases the second output potential on the reference potential. With alternating operation of the gas discharge lamp with equal periods, an average output voltage is established, with a value differing from the reference potential.

In another alternative exemplary embodiment, the gas discharge lamp is accommodated in a housing whose potential is at the reference potential. Thus, a potential difference is built up between the housing and the gas discharge lamp, reducing the migration of ions, as explained above.

This gas discharge lamp is preferably used in an automotive headlamp.

DETAILED DESCRIPTION OF THE INVENTION

Figure 1:
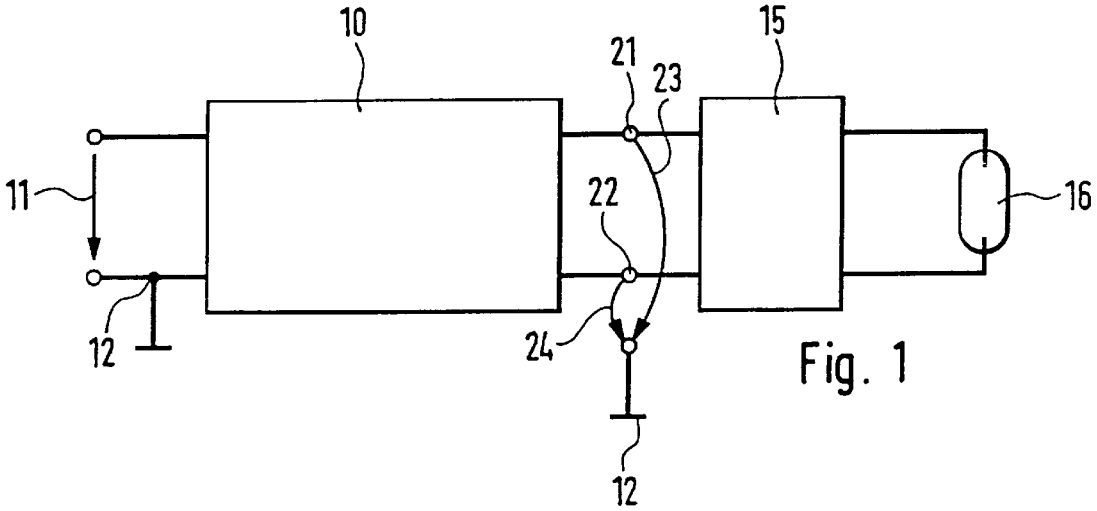
FIG. 1 shows a block diagram of an exemplary embodiment according to the present invention.

An input voltage 11 based on a reference potential 12 is converted by a d.c.-d.c. converter 10 into two output potentials which can be picked off at a first output terminal 21 and a second output terminal 22. If the first output potential is picked off at first output terminal 21 and based on reference potential 12, this yields first output voltage 23, and the second output potential picked off at second output terminal 22, based on reference potential 12, yields second output voltage 24. The two output potentials are sent to a drive circuit 15 which in turn supplies a gas discharge lamp 16.

The time characteristic of a lamp voltage 26, which could be established on gas discharge lamp 16, fluctuates at equal intervals between first output voltage 23 and second output voltage 24. An average 25 of this lamp voltage 26 is established here.

The device according to the present invention for operating a gas discharge lamp 16 functions as follows:

Input voltage 11 based on reference potential 12 is converted by d.c.-d.c. converter 10 to a bipolar output voltage. For example, a d.c. voltage taken from a battery serves as input voltage 11. In this connection, bipolar d.c.-d.c. converter 10 is understood to be a d.c.-d.c. converter 10 which converts input voltage 11 based on reference potential 12 into two output potentials which are different from reference potential 12. Such d.c.-d.c. converters 10 are known in the art. Single-ended flyback converters or single-ended forward converters may be used as well as push-pull converters, for example, with transformer electrical separation. In addition to transformer electrical separation, a second output potential different from reference potential 12 could be achieved by the fact that the transformer current flowing in primary circuit goes over a diode and a smoothing capacitor to first output terminal 21, while the current flowing in secondary circuit goes to second output terminal 22.

These two output potentials different from reference potential 12 form the input variables of drive circuit 15. This ensures that gas discharge lamp 16 receives an alternating current because the lifetime of gas discharge lamp 16 would be severely impaired by a direct current. Drive circuit 15 may have an H bridge, for example, with gas discharge lamp 16 in its diagonal brace. By suitable driving of the four circuit-breakers, the first and second output potentials are alternately applied to the terminals of gas discharge lamp 16. The clocking in the embodiment is constant. This ensures establishment of an average 25 with a different potential from reference potential 12. Likewise, clocked polarity reversal is also conceivable.

Figure 2:
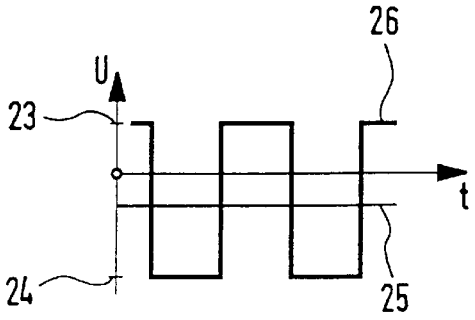
FIG. 2 shows a voltage characteristic of a gas discharge lamp.

Drive circuit 15 produces a square-wave characteristic of lamp voltage 26 according to FIG. 2. First and second output voltages 23, 24 are applied in alternation to gas discharge lamp 16 with the same period. Average 25 can also be implemented by different drive periods with respect to the first and second output potential. However, this also increases the cost of the drive circuit.

Gas discharge lamp 16 can be used in motor vehicles in particular. If the lamp socket or the housing of gas discharge lamp 16 is at device ground, the desired potential difference is achieved. Negative average 25 based on device ground prevents unwanted migration of ions.

What is claimed is:

1. A device for operating a gas discharge lamp, comprising:

a d.c.-d.c. converter converting an input voltage, based on a reference potential, to at least two output potentials, the at least two output potentials being different from the reference potential; and a drive circuit arrangement bringing the gas discharge lamp to the at least two output potentials, a first absolute value of one of the at least two output potentials being different from a second absolute value of another of the at least two output potentials.

2. The device according to claim 1, wherein a first output voltage bases a first output potential of the at least two output potentials on the reference potential, wherein a second output voltage bases a second output potential of the at least two output potentials on the reference potential, and wherein a first polarity of the first output voltage is different from a second polarity of the second output voltage.

3. The device according to claim 1, wherein the gas discharge lamp is arranged in a housing and wherein a potential of the housing is at the reference potential.

4. The device according to claim 1, wherein an automotive headlamp includes the gas discharge lamp.

5. The device according to claim 1, wherein:

the d.c.-d.c. converter includes at least two inputs, and one input of the at least two inputs of the d.c.-d.c. converter is directly switched to the reference potential.

* * * * *